US006015624A

United States Patent [19]

Williams

[11] Patent Number: 6,015,624

[45] Date of Patent: Jan. 18, 2000

[54] INK-RECEPTIVE SHEET

[75] Inventor: Donald J. Williams, Austin, Tex.

[73] Assignee: 3M Innovative Properties Company, St. Paul, Minn.

[ * ] Notice: This patent is subject to a terminal disclaimer.

[21] Appl. No.: 08/986,562

[22] Filed: Dec. 5, 1997

Related U.S. Application Data

[63] Continuation-in-part of application No. 08/690,891, Aug. 2, 1996, abandoned, which is a continuation-in-part of application No. 08/395,999, Feb. 28, 1995, abandoned.

[51] Int. Cl.[7] ..... B41M 5/00

[52] U.S. Cl. ..... 428/500; 428/195; 428/213; 428/215; 428/323; 428/411.1; 428/483; 428/508; 428/515; 347/105

[58] Field of Search ..... 428/195, 212, 428/213, 215, 323, 325, 411.1, 482, 483, 500, 508, 515; 347/105; 525/55, 191, 221, 240, 418

[56] References Cited

U.S. PATENT DOCUMENTS

| | | | |
|---|---|---|---|
| 4,636,805 | 1/1987 | Toganoh et al. | 346/1.1 |
| 4,678,833 | 7/1987 | McCreedy et al. | 525/66 |
| 4,686,118 | 8/1987 | Arai et al. | 427/261 |
| 4,701,837 | 10/1987 | Sakaki et al. | 346/135.1 |
| 4,849,286 | 7/1989 | Milne | 428/336 |
| 4,889,765 | 12/1989 | Wallace | 428/290 |
| 5,068,140 | 11/1991 | Malhotra et al. | 428/216 |
| 5,118,570 | 6/1992 | Malhotra | 428/474.4 |
| 5,120,601 | 6/1992 | Kotaki et al. | 428/327 |
| 5,134,198 | 7/1992 | Stofko, Jr. et al. | 525/205 |
| 5,192,617 | 3/1993 | Stofko, Jr. et al. | 428/411.1 |
| 5,208,092 | 5/1993 | Iqbal | 428/195 |
| 5,219,928 | 6/1993 | Stofko, Jr. et al. | 525/57 |
| 5,241,006 | 8/1993 | Iqbal et al. | 525/196 |
| 5,277,965 | 1/1994 | Malhotra | 428/216 |
| 5,342,688 | 8/1994 | Kitchin et al. | 428/402 |
| 5,369,168 | 11/1994 | Famili et al. | 525/57 |
| 5,369,179 | 11/1994 | Havens | 525/183 |
| 5,376,727 | 12/1994 | Iqbal et al. | 525/196 |
| 5,389,723 | 2/1995 | Iqbal et al. | 525/57 |
| 5,460,874 | 10/1995 | Rao | 428/327 |
| 5,567,507 | 10/1996 | Paff et al. | 428/213 |

FOREIGN PATENT DOCUMENTS

| | | |
|---|---|---|
| 0 227 245 A2 | 7/1987 | European Pat. Off. . |
| 0 583 141 A2 | 2/1994 | European Pat. Off. . |
| WO 88/06532 | 9/1988 | WIPO . |

*Primary Examiner*—Marie Yamnitzky
*Attorney, Agent, or Firm*—Darla P. Fonseca

[57] ABSTRACT

A fast-drying ink-receptive sheet having a coating comprising a blend of from about 35% to about 85% of at least one hydrophilic liquid absorbent polymer and from about 15% to about 65% of a polyethylene-acrylic acid copolymer, having a preferred acrylic acid level of at least about 10%; such coating can be used alone, or preferably such coating is part of a coating system also including an ink-transmissive upper layer which provides improved mud-cracking properties.

18 Claims, 4 Drawing Sheets

INK-RECEPTIVE SHEET

This application is a continuation-in-part of U.S. Ser. No. 08/690,891, filed Aug. 2, 1996, now abandoned, which is a continuation-in-part of U.S. Ser. No. 08/395,999, filed Feb. 28, 1995, now abandoned.

BACKGROUND OF RELATED ART

The invention relates to transparent materials that can be used as ink-receptive sheets for imaging, and more particularly, to improved ink-receptive coatings thereon, providing improved image quality.

DESCRIPTION OF RELATED ART

Imaging devices such as ink jet printers and pen plotters are well known methods for printing various information including labels and multi-colored graphics. Presentation of such information has created a demand for transparent ink-receptive imageable receptors that are used as overlays in technical drawings and as transparencies for overhead projection. Imaging with either the ink jet printer or the pen plotter involves depositing ink on the surface of these transparent receptors. These imaging devices conventionally utilize inks that can remain exposed to air for long periods of time without drying.

Since it is desirable that the surface of these receptors be dry and non-tacky to the touch, even after absorption of significant amounts of liquid soon after imaging, transparent materials that are capable of absorbing significant amounts of liquid while maintaining some degree of durability and transparency, are useful as imageable receptors for imaging.

Liquid-absorbent materials disclosed in U.S. Pat. Nos. 5,134,198, 5,192,617, 5,219,928 and 5,241,006 attempt to improve drying and decrease dry time. These materials comprise crosslinked polymeric compositions capable of forming continuous matrices for liquid absorbent semi-interpenetrating polymer networks. These networks are blends of polymers wherein at least one of the polymeric components is crosslinked after blending to form a continuous network throughout the bulk of the material, and through which the uncrosslinked polymeric components are intertwined in such a way as to form a macroscopically homogeneous composition. Such compositions are useful for forming durable ink absorbent, transparent graphical materials.

WO 8806532 (AM International) discloses a recording transparency and an aqueous method of preparation. The transparency is coated with a hydroxyethylcellulose polymer or mixture of polymers. The coating solution may also contain a surfactant to promote leveling and adhesion to the surface, and hydrated alumina in order to impart pencil tooth to the surface.

U.S. Pat. No. 5,120,601 (Asahi) discloses a recording sheet comprising an ink receiving layer containing highly water absorptive 1 to 100 $\mu$m resin particles and a binder. The resin particles protrude to a height of not less than 1 $\mu$m from the surface of the binder layer and comprise from 50 to 5,000 per 1 $mm^2$ surface. The resin particles include sodium, lithium and potassium polyacrylates; vinyl alcohol/acrylamide copolymer; sodium acrylate/acrylamide copolymer; cellulose polymers; starch polymers; isobutylene/maleic anhydride copolymer; vinyl alcohol/acrylic acid copolymer; polyethylene oxide modified products; dimethyl ammonium polydiallylate; and quaternary ammonium polyacrylate. Useful binders can be any hydrophilic resin, e.g., starch, gelatin, celluloses, polyethyleneimine, polyacrylamide, polyvinyl-pyrrolidones polyvinyl alcohols, polyester, sodium polyacrylate, polyethylene oxide, poly-2-hydroxyethyl methacrylate, crosslinked hydrophilic polymers, hydrophilic water soluble polymer complexes, and the like.

U.S. Pat. No. 4,636,805 (Canon) discloses a recording medium comprising an ink receiving layer capable of fixing an ink within 3 minutes at 20° C. and 65% RH to the extent of 0.7 ml/$cm^2$. One embodiment contains hydroxyethyl cellulose. Other materials are disclosed such as various gelatins; polyvinyl alcohols; starches; cellulose derivatives; polyvinylpyrrolidone, polyethyleneimine; polyvinylpyridinum halide, sodium polyacrylate, SBR and NBR latexes; polyvinylformal; PMMA; polyvinylbutyral; polyacrylonitrile; polyvinylchloride; polyvinylacetate; phenolic resins and so on.

U.S. Pat. No. 4,701,837 (Canon) discloses a light transmissive recording medium having an ink receiving layer formed mainly of a water soluble polymer and a crosslinking agent. The crosslinked polymer has a crosslinking degree satisfying the water resistance of the receiving layer while giving the layer the ink receiving capacity of 0.2. microliters/square centimeter. The water soluble polymer may include natural polymers or modified products thereof such as gelatin, casein, starch, gum arabic, sodium alginate, hydroxyethyl cellulose, carboxyethyl cellulose and the like; polyvinyl alcohols; complete or partially saponified products of vinylacetate and other monomers; homopolymers or copolymers with other monomers of unsaturated carboxylic acids such as (meth)acrylic acid, maleic acid, crotonic acid and the like; copolymers or homopolymers with other vinyl monomers of sulfonated vinyl monomers such as vinylsulfonic acid, sulfonated styrene and the like; copolymers or homopolymers with other vinyl monomers of (meth) acrylamide; copolymers or homopolymers with other vinyl monomers of ethylene oxide; terminated polyurethanes having blocked isocyanate groups; polyamides having such groups as mentioned above; polyethyleneimine; polyurethane; polyester; and so on.

U.S. Pat. No. 5,277,965 (Xerox) discloses a recording medium comprising a base sheet with an ink receiving layer on one surface, and a heat absorbing layer on the other, and an anti-curl layer coated on the surface of the heat absorbing layer. The materials suitable for the ink-receptive layer can include hydrophilic materials such as binary blends of polyethylene oxide with one of the following group: hydroxypropyl methyl cellulose (Methocel®), hydroxyethyl cellulose; water-soluble ethylhydroxyethyl cellulose, hydroxybutylmethyl cellulose, hydroxypropyl cellulose, methyl cellulose, hydroxyethylmethyl cellulose; vinylmethyl ether/maleic acid copolymers; acrylamide/acrylic acid copolymers; salts of carboxymethylhydroxyethyl cellulose; cellulose acetate; cellulose acetate hydrogen phthalate, hydroxypropyl methyl cellulose phthalate; cellulose sulfate; PVA; PVP; vinyl alcohol/vinylacetate copolymer and so on.

U.S. Pat. No. 5,118,570 (Xerox) discloses a transparency comprising a hydrophilic coating and a plasticizer. The plasticizer can be selected from the group consisting of anhydrides, glycerols, glycols, substituted glycerols, pyrrolidinones, alkylene carbonates, sulfolanes, and stearic acid derivatives. In one specific embodiment directed to a humidity resistant ink jet transparency, the coating comprised of a ternary mixture of hydroxypropyl cellulose, carboxymethyl cellulose, polyethylene oxide and a plasticizer. This coating can also have dispersed therein additives such as colloidal silica. Another specific is a blend comprised of polyethylene oxide and carboxymethyl cellulose together with a component selected from the group consisting of (1) hydroxypropyl cellulose; (2) vinylmethyl ether/maleic acid copolymer; (3) carboxymethyl hydroxypropyl cellulose; (4) hydroxyethyl cellulose; (5) acrylamide/acrylic acid copolymer; (6) cellulose sulfate; (7) poly(2-acrylamido-2-methylpropane) sulfonic acid; (8) poly(vinyl alcohol); (9) poly(vinyl pyrrolidone); and (10) hydroxypropyl methyl cellulose.

U.S. Pat. No. 5,068,140 (Xerox) discloses a transparency comprised of a supporting substrate and an anticurl coating or coatings thereunder. In one specific embodiment, the transparency comprises of an anticurl coating comprising two layers. The ink receiving layer in one embodiment is comprised of blends of poly(ethylene oxide), mixtures of poly(ethylene oxide) with cellulose such as sodium carboxymethyl cellulose, hydroxymethyl cellulose and a component selected from the group consisting of (1) vinylmethyl ether/maleic acid copolymer; (2) hydroxypropyl cellulose; (3) acrylamide/acrylic acid copolymer, (4) sodium carboxymethylhydroxyethyl cellulose; (5) hydroxyethyl cellulose; (6) water soluble ethylhydroxyethyl cellulose; (7) cellulose sulfate; (8) poly(vinyl alcohol); (9) polyvinyl pyrrolidone; (10) poly(acrylamido 2-methyl propane sulfonic acid); (11) poly(diethylenetriamine-co-adipic acid); (12) poly(imidazoline) quaternized; (13) poly(N,N-methyl-3-S dimethylene piperidinum chloride; (14) poly(ethylene imine)epichlorohydrin modified; (15) poly(ethylene imine) ethoxylated; blends of poly(a-methylstyrene) with a component having a chlorinated compound.

As previously disclosed, generation of an image by an ink jet printer results in large quantities of solvent, generally blends of glycols and water, which remain in the imaged areas. Hence ink-receptive coatings are coated onto substrates to absorb the solvent quickly to form good images. Many of the materials disclosed above already address this requirement for absorbency, However, even when the absorbency is adequate, diffusion of solvent into unimaged areas can result in "bleeding" of the image, when the dye is carried along with the solvent.

U.S. Pat. No. 5,342,688 addresses this bleeding problem. It discloses an improved ink-receptive sheet comprising a transparent substrate bearing on at least one major surface thereof an ink-receptive layer which comprises at least one hydrophilic liquid absorbent polymer and an effective amount of polymeric mordant comprising a guanidine functionality.

With the advent of pigmented inks, other problems are encountered when these same prior art materials are used as ink-receptive coatings. One of the problems can be characterized as 'mud-cracking'. Without wishing to be bound by theory, it is believed that the pigment, along with other ink components, e.g., polymeric dispersants, and possibly certain dissolved components of the receptor layer, form a separate layer on the surface of the ink-receptive coating. Upon drying, this layer can literally fracture, and result in cracks which are visible to the eye, and accompanying poor image quality and low optical densities. This effect is quite apparent with some printers already on the market, for example, HP Deskjet® 1200C, and is more severe with some machines than others. Therefore, other materials need to be incorporated into the coatings to improve image quality. The inventors have now discovered an ink-receptive sheet useful for projecting an image, commonly called a "transparency" which, when coated with an ink-receptive coating and imaged with an ink depositing device can be successfully printed with pigmented typed-inks with good image quality.

Preferred embodiments of this invention also have reduced image bleeding, improved shelf life, even when it is exposed to elevated temperature and high humidity, or in cases where solvent is prevented from leaving the coating, e.g., when stored in a transparency protector, and also display excellent drytimes.

The present invention discloses a copolymer which when added to an ink-absorbent layer, can improve the dry time of that layer while giving good image quality.

SUMMARY OF THE INVENTION

Improved ink-receptive sheets of the invention have a substrate with an ink-receptive coating thereon. Ink-receptive coatings used herein comprise a hydrophilic liquid absorbent polymer, a copolymer which provides fast drying and an admixture of other additives which work together to provide a coating which will, when imaged, provide a fast-drying, high-quality image with no surface cracks or bleeding.

The ink-receptive coatings used in sheets of the invention comprise a blend of from about 15% to about 65% by weight of a polyethylene-acrylic acid copolymer and, from about 35% to about 85% by weight of at least one hydrophilic liquid absorbent polymer. The presence of the polyethylene-acrylic acid copolymer improves the drytime of the coating while maintaining good image quality, when printed with aqueous inks. The polyethylene-acrylic acid copolymer preferably has at least about 10% by weight acrylic acid content, more preferably at least about 20% by weight acrylic acid content.

In one embodiment, this invention comprises an ink-receptive coating system comprising at least two layers; a thick base layer for ink absorption comprising a polyethylene-acrylic acid copolymer and a hydrophilic liquid absorbent polymer, and a thin ink-transmissive upper layer which may function to improve tack, feeding, dry time, bleed, mud-cracking, wetting, and the like.

In a preferred embodiment of the two layer ink-receptive coating system, the base layer comprises a blend having from about 15% to about 65% by weight polyethylene-acrylic acid copolymer and, from about 35% to about 85% of at least one hydrophilic liquid absorbent polymer, and the ink-transmissive upper layer comprises a relatively high viscosity methylcellulose or hydroxypropylmethylcellulose, or blends thereof, e.g., having a viscosity of more than 2,000 centipoise in a 20% aqueous solution. These ink-receptive coating systems have fast dry times and, when coated onto substrates, yield good image quality when printed on printers using aqueous inks including pigmented-type inks.

In a highly preferred embodiment of the two-layer ink-receptive coating system, the base layer comprises a polyethylene-acrylic acid copolymer and polyvinylpyrrolidone, and the ink-transmissive layer comprises a) a high viscosity methylcellulose binder, hydroxypropylmethylcellulose binder, or blends thereof, and b) an organic acid salt selected from the group consisting of salts of polyethyleneimine and salts of substituted polyethyleneimine.

Optional ingredients such as a mordant can also be present either in the top layer or the base or both layers.

The thickness of the single layer coating and the base layer for the two-layer coating system preferably ranges from about 10 $\mu$m to about 40 $\mu$m; when used, the ink-transmissive upper layer preferably has a thickness of from about 0.5 $\mu$m about 10 $\mu$m.

As used herein, these terms have the following meanings.

1. The term "mud-cracking" means a physical cracking or fracturing of the pigmented ink layer of image resulting in lower density and quality. The cracks are so called because they resemble the cracking visible in the mud of a dry gulch.

2. The terms "hydrophilic" and "hydrophilic surface" are used to describe a material that is generally receptive to water, either in the sense that its surface is wettable by water or in the sense that the bulk of the material is able to absorb significant quantities of water. Materials that exhibit surface wettability by water have hydrophilic surfaces.

3. The term "hydrophilic liquid-absorbing materials" means materials that are capable of absorbing significant quantities of water, aqueous solutions, including those materials that are water-soluble.

4. The terms "hydrophobic" and "hydrophobic surface" refer to materials which have surfaces not readily wettable by water. Monomeric units will be referred to as hydrophobic if they form water-insoluble polymers capable of absorbing only small amounts of water when polymerized by themselves.

5. The term "mordant" means a compound which, when present in a composition, interacts with a dye to prevent diffusion of dye through the composition 6. The term "pigment layer" means that layer generated on the surface of the transparency comprised of the pigment, polymeric dispersants, and various components from the receptor layer.

7. The term "high viscosity", when used to refer to the methylcellulose compound, means having a viscosity of at least about 2,000 centipoise when in a 20% aqueous solution.

All parts, percents, and ratios herein are by weight unless otherwise specifically stated.

DETAILED DESCRIPTION OF THE INVENTION

Figure 1:
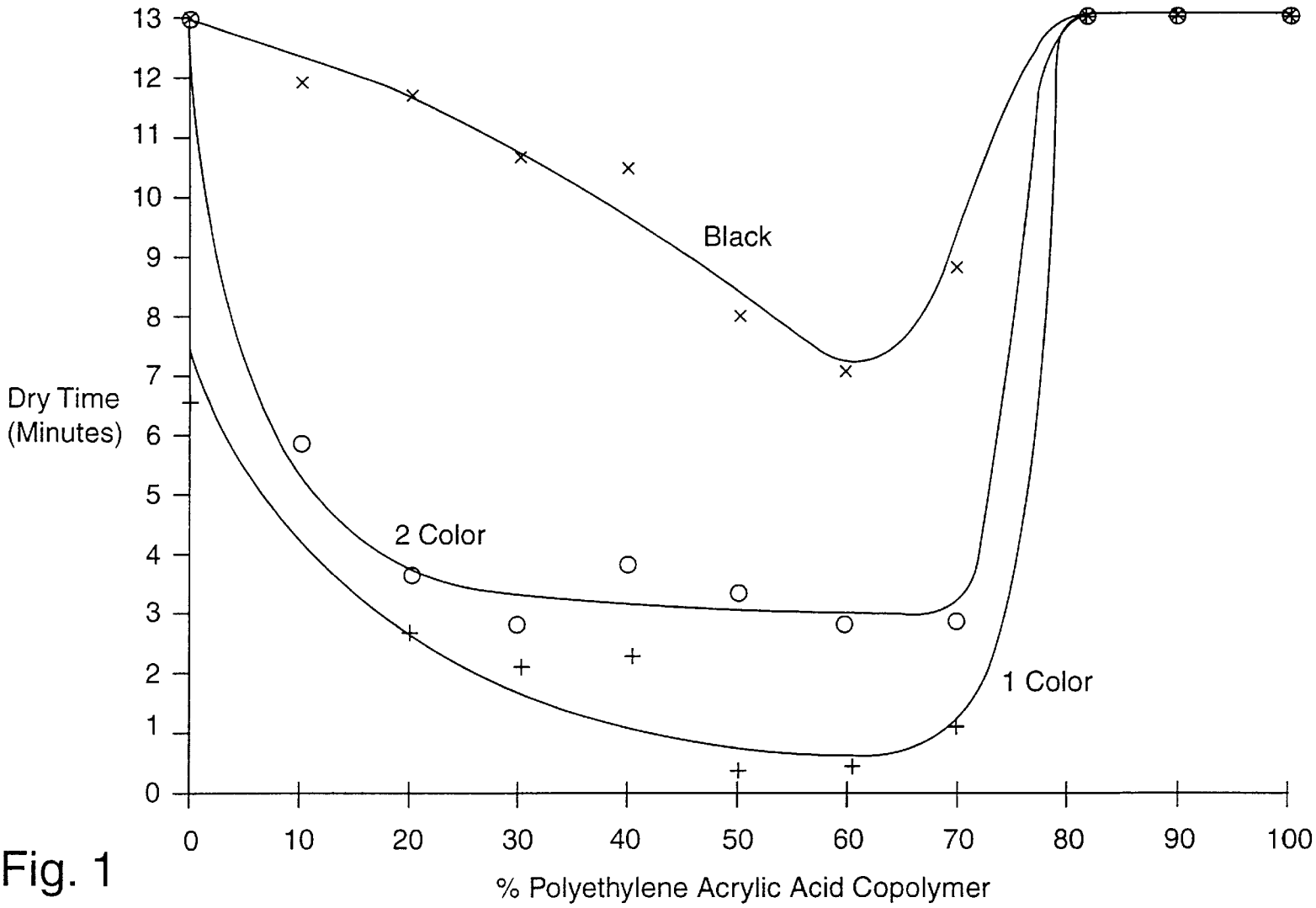
FIG. 1 shows a plot wherein the abscissa shows polyethylene-acrylic acid copolymer percentage of the polymer blend in a single ink-receptive layer, plotted against the drytimes of ink-receptive sheet of the invention in minutes.

In ink jet printing, large amounts of liquid are placed onto the surface to be imaged, relative to other types of printing. The printing surface must be able to absorb all the liquid and dry quickly. If an ink-receptive sheet does not dry within minutes or even seconds, it will not meet with consumer approval. Delays in drying cause smudging of the image, handling problems, and the inability to use the sheets immediately. Further, if stacked or stored before completely dry, they will stick to one another, or to a storage envelope.

It was particularly noticed that as the percentage of polyethylene/acrylic acid copolymer in the coating decreased to less than 50%, this effect became smaller and disappeared totally at about 35%.

The ink-receptive sheets of the present invention comprise a coating system which may comprise a single relatively thick liquid-absorbent layer, or a two-layer coating system having a thick base layer and a thinner ink-transmissive upper layer. Where a single layer is used, the thickness of the single layer preferably ranges from about 10 $\mu$m to about 40 $\mu$m. Where a two-layer coating system is used, the base layer is the same thickness as the single layer coating, and the ink-transmissive upper layer preferably has a thickness of from about 0.5 $\mu$m to about 10 $\mu$m.

The absorbent layer comprises a blend of polymers to total 100%; from about 15% to about 65% by weight of the blend is a polyethylene-acrylic acid copolymer, correspondingly, from about 35% to about 85% by weight is at least one liquid-absorbent polymer. Preferred blends comprise from about 20% to about 55% of the polyethylene-acrylic acid copolymer. Presence of polyethylene-acrylic acid copolymers in the blend improves the dry time while maintaining good image quality. Preferred copolymers include those having at least about 10% by weight acrylic acid content, more preferably at least about 20% by weight acrylic acid content.

Preferred liquid absorbent hydrophilic polymeric compounds used in the single layer system, and base layer of the two-layer system, along with the polyethylene-acrylic acid polymer include uncrosslinked hydrophilic liquid absorbent polymers such as polyacrylamides, polyvinylpyrrolidone and modified polyvinyl pyrrolidones, polyvinyl alcohol and modified polyvinyl alcohols, and other hydrophilic and liquid absorptive polymers comprising copolymerizable monomers such as:

a) nitrogen-containing hydrophilic and water absorptive monomers such as vinyl lactams, e.g., N-vinyl-2-pyrrolidone; acrylarnide, methacrylamide and their N-monoalkyl and N,N-dialkyl derivatives thereof; alkyltertiaryaminoalkylacryates and methacrylates; vinylpyridines such as 2-vinyl and 4-vinyl pyridines; preferably N-vinyl-2-pyrrolidone; acrylamide, methacrylamide and their N-monoalkyl and N,N-dialkyl derivatives thereof; and b) hydrophilic monomers selected from hydroxyalkyl acrylate and methacrylate, wherein the alkyl group has from about 1 to about 5 carbon atoms, preferably from 1 to 2 carbon atoms, and more preferably hydroxyethyl acrylate and methacrylate; alkoxyalkyl acrylate and methacrylate, the alkyl group preferably containing from 1 to 5 carbon atoms, preferably from 1 to 2 carbon atoms.

Modified polyvinylpyrrolidones include such copolymers as NVP/vinyl acetate copolymers, e.g., those available commercially from as "S-630" and "W735", NVP/DMAEMA copolymers available as Gafquat® 755, NVP/acrylic acid copolymers, available as ACRYLIDONE®, and NVP/MEAHEMA/AA copolymers, such as "copolymer 958", all of which are available from I.S.P. Technologies Inc., Wayne, N.J., modified polyvinylalcohols include polyvinylalcohols having various percentages of vinylacetate, methylcellulose polymers, and the like.

The preferred material for the liquid absorbent layer is a blend of polyvinylpyrrolidone and polyethylene-acrylic acid copolymer. The preferred polyethylene-acrylic acids include those having at least about 10%, preferably at least about 20% by weight acrylic acid content. The presence of a blend of polyvinylpyrrolidone, available commercially as PVP-K-

90 and a polyethylene-acrylic acid copolymer having 20% acrylic acid content, available commercially as Primacor® 5980, in the liquid absorbent layer gives excellent dry times, especially when used in the two layer system with the preferred top layer constructions. The improved dry times are seen on essentially all ink jet printers.

The liquid absorbent layer can also comprise a crosslinked semi-interpenetrating network, or "SIPN". The SIPN for this ink-receptive coating would be formed from polymer blends comprising (a) at least one crosslinkable polyethylene-acrylic acid copolymer, (b) at least one hydrophilic liquid absorbent polymer, and (c) a crosslinking agent. The SIPNs are continuous networks wherein the crosslinked polymer forms a continuous matrix, as disclosed in U.S. Pat. Nos. 5,389,723, 5,241,006, 5,376,727, and 5,208,092, incorporated herein by reference.

An ink-transmissive upper layer is also preferably present in addition to the liquid absorbent layer. This is applied on top of the liquid absorbent base layer. This upper layer is thinner, and comprises polymeric materials such as polyvinylpyrrolidone, polyvinyl-alcohol, modified celluloses, and mixtures thereof.

In one preferred embodiment, to maximize image quality and substantially eliminate mud-cracking with most pigmented-type inks, the upper layer contains high viscosity modified cellulose binders such as methylcellulose, hydroxypropylmethylcellulose and hydroxyethyl-methylcellulose and mixtures thereof.

In this embodiment, certain cellulose derivatives are unsuitable for use as binders for elimination of mud-cracking. These derivatives include hydroxyethyl cellulose, hydroxymethyl cellulose, and carboxymethyl cellulose, although these may be used as additives when they comprise less than about 40% of the overall cellulose content, or where mud-cracking is not prevalent, or critical. Useful but less preferred cellulose derivatives as binders due to their hydrophobic nature, water insolubility, need for organic solvents, and tendency to cause coalescence of pigmented as well as colored ink jet inks include ethylcellulose, ethylhydroxyethyl cellulose and hydroxybutyl cellulose. These may also be used as additives with appropriate solvent blends when they comprise less than about 40% of the overall cellulose content. Hydroxypropyl cellulose, although water soluble, is less suitable as a binder for the same reasons as the latter materials, although it may likewise be used when it comprises less than 40% of the overall cellulose content.

The upper layer can also comprise organic acid salts of polyethyleneimine for further improvements including in drytime, reduced smudging of the images, image brightness and reduction/elimination of bleeding. Useful acids include dicarboxylic acid derivatives, containing 2–14 carbon atoms, phthalic acids, hydrochloric acid, boric acid, and substituted sulfonic acids, such as methanesulfonic acid, with preferred one being p-toluenesulfonic acid. The upper layer may also comprise additives in addition to the celluloses mentioned above that can improve drytimes, color quality, tack, and the like, in greater quantities which do not degrade the mud-cracking performance of the pigmented ink. These additives include water soluble polymers such as polyacrylic acid, polyvinylpyrrolidone, GAF Copolymer 845, polyethylene oxide, water soluble starches, e.g. Staylok® 500 and water dispersible and water suspendible clays, e.g. Laponite® RDS, and inorganic sols as long as these additives comprise less than about 40% of the topcoat solids.

An additive which may be present to control curl is a plasticizing compound, which is added to the base layer of the film. Useful compounds include low molecular weight polyethylene glycols, polypropylene glycols, or polyethers; for example PEG 600 or Pycal® 94.

One preferred additive, a mordant, for reduction of ink fade and bleed, can also be present either in the top layer, the base layer, or both. Whether present in the top layer or base layer, the amount is preferred to range from about 1 parts by weight to 20 parts by weight of the solids, preferably from about 3 parts by weight to 10 parts by weight.

Feedability and antiblocking properties may also be controlled by the addition of a particulate. Suitable particulates include starches, glass beads, silicas, polymeric microspheres and beads, with a preferred embodiment comprising polymethyl methacrylate (PMMA) beads. Levels of particulate are limited by the requirement that the final coating be transparent with a haze level of 15% or less, as measured according to ASTM D1003-61 (Reapproved 1979). The preferred mean particle diameter for particulate material is from about 5 to about 40 micrometers, with at least 25% of the particles having a diameter of 15 micrometers or more. Most preferably, at least about 50% of the particulate material has a diameter of from about 20 micrometers to about 40 micrometers. While the particulate may be added to either or both layers, preferred embodiments contain the particulate in the upper layer.

Other optional ingredients may be present in the upper layer for the purposes of improving coatability, or other features. Useful additives include such as catalysts, thickeners, adhesion promoters, glycols, defoamers, surfactants, colloidal silica, boric acid and the like, so long as the addition does not negatively impact the drying time.

The ink-receptive layer(s), can be applied to the film backing by any conventional coating technique, e.g., deposition from a solution or dispersion of the resins in a solvent or aqueous medium, or blend thereof, by means of such processes as Meyer bar coating, knife coating, reverse roll coating, rotogravure coating, and the like. When two layers are used, the upper layer can then be applied thereover by the same or different conventional processes.

Drying of the ink-receptive layer(s) can be effected by conventional drying techniques, e.g., by heating in a hot air oven at a temperature appropriate for the specific film backing chosen. For example, a drying temperature of about 120° C. is suitable for a polyester film backing.

Film substrates may be formed from any polymer capable of forming a self-supporting sheet, e.g., films of cellulose esters such as cellulose triacetate or diacetate, polystyrene, polyamides, vinyl chloride polymers and copolymers, polyolefin and polyallomer polymers and copolymers, polysulphones, polycarbonates, polyesters, and blends thereof. Suitable films may be produced from polyesters obtained by condensing one or more dicarboxylic acids or their lower alkyl diesters in which the alkyl group contains up to about 6 carbon atoms, e.g., terephthalic acid, isophthalic, phthalic, 2,5-,2,6-, and 2,7-naphthalene dicarboxylic acid, succinic acid, sebacic acid, adipic acid, azelaic acid, with one or more glycols such as ethylene glycol, 1,3-propanediol, 1,4-butanediol, and the like.

Preferred film substrates or backings are cellulose triacetate or cellulose diacetate, poly(ethylene naphthalate), polyesters, especially poly(ethylene terephthalate), and polystyrene films. Poly(ethylene terephthalate) is most preferred. It is preferred that film backings have a caliper ranging from about 50 $\mu$m to about 200 $\mu$m. Film backings having a caliper of less than about 50 $\mu$m are difficult to handle using conventional methods for graphic materials. Film backings having calipers over 200 $\mu$m are stiffer, and present feeding difficulties in certain commercially available ink jet printers and pen plotters.

When polyester film substrates are used, they can be biaxially oriented to impart molecular orientation, and may also be heat set for dimensional stability during fusion of the image to the support. These films may be produced by any conventional extrusion method.

To promote adhesion of the ink-receptive layer to the film backing, it may be desirable to treat the surface of the film backing with one or more primers, in single or multiple layers. Useful primers include those known to have a swelling effect on the film backing polymer. Examples include halogenated phenols dissolved in organic solvents. Alternatively, the surface of the film backing may be modified by treatment such as corona treatment or plasma treatment.

Image-receptive sheets of the invention are particularly suitable for the production of imaged transparencies for viewing in a transmission mode or a reflective mode, i.e., in association with an overhead projector.

The following examples are for illustrative purposes, and do not limit the scope of the invention, which is that defined by the claims.

DETAILED DESCRIPTION OF THE DRAWINGS

In FIG. 1, it is shown that when the percentage of polyethylene-acrylic acid copolymer present in the polymer blend of the ink-receptive layer is between about 15% and about 65%, the drytime is approximately 5 minutes or less. When the percentage either decreases below 15%, or increases above about 65%, the dry time increases. At highly preferred percentages of from about 20% to about 60%, the dry time may be 4 minutes or less. The black plot represents an area where three colors of ink have been deposited (cyan, magenta, and yellow), the two-color plot represents average values of dry times for the blue and red inks (formed by deposition of cyan and magenta inks, and yellow and magenta inks respectively), and the one-color plot represents average values of dry times for the cyan and magenta inks. It is obvious that when more ink is deposited, dry times increase, due to the increased amount of ink solvent that must be absorbed or evaporated.

Figure 2:
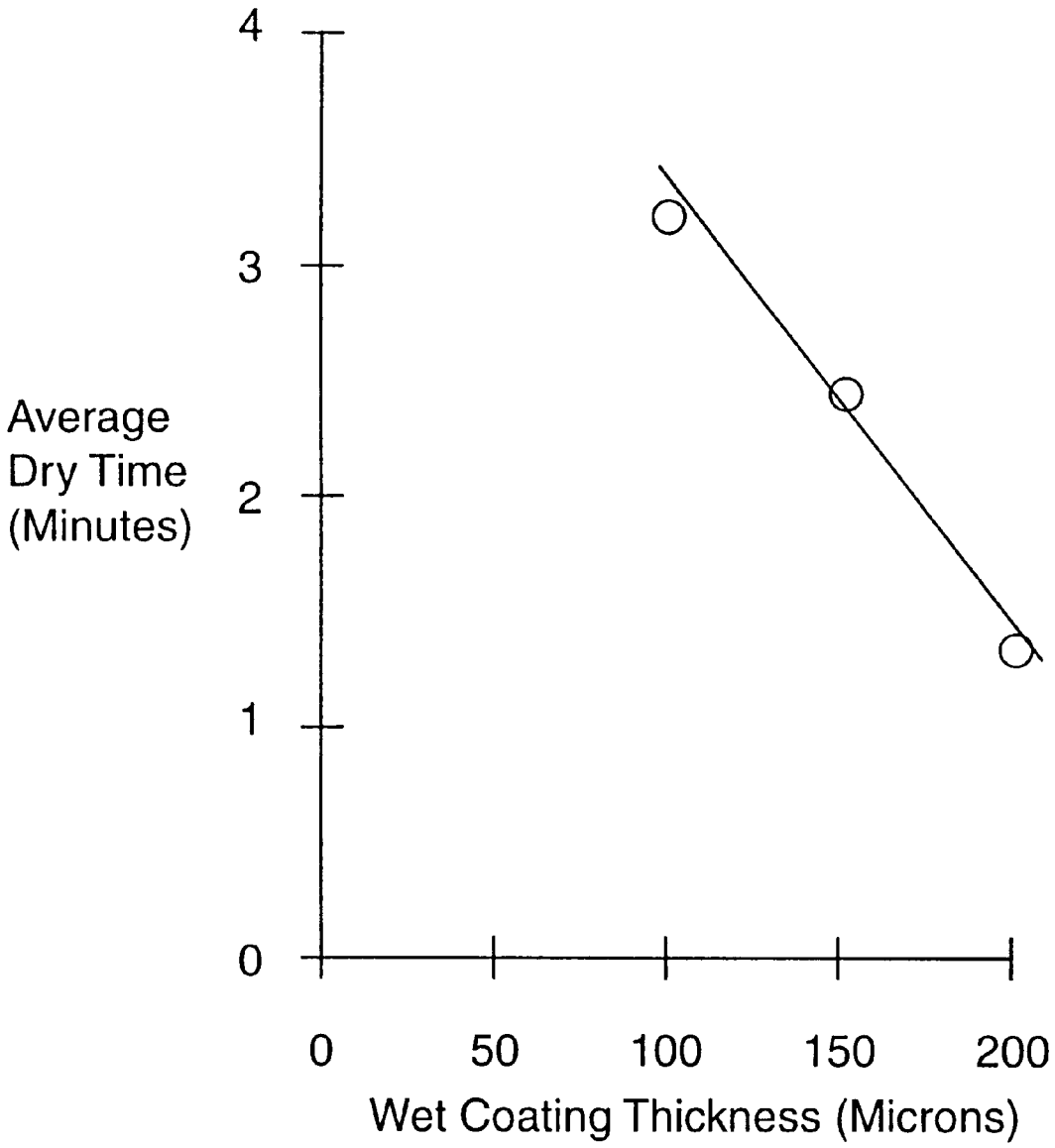
FIG. 2 shows a plot of average dry times for a specific composition as the coating thickness is varied.

In FIG. 2, average dry time is plotted against wet coating thickness, and hence coating weight. Average dry time is the average of the dry times for black, blue, red, cyan and magenta ink dry times. The coating formulation used to generate this figure was a 50/50 mixture by weight of a polyethylene-acrylic acid copolymer and poly vinyl pyrrolidone.

Figure 3:
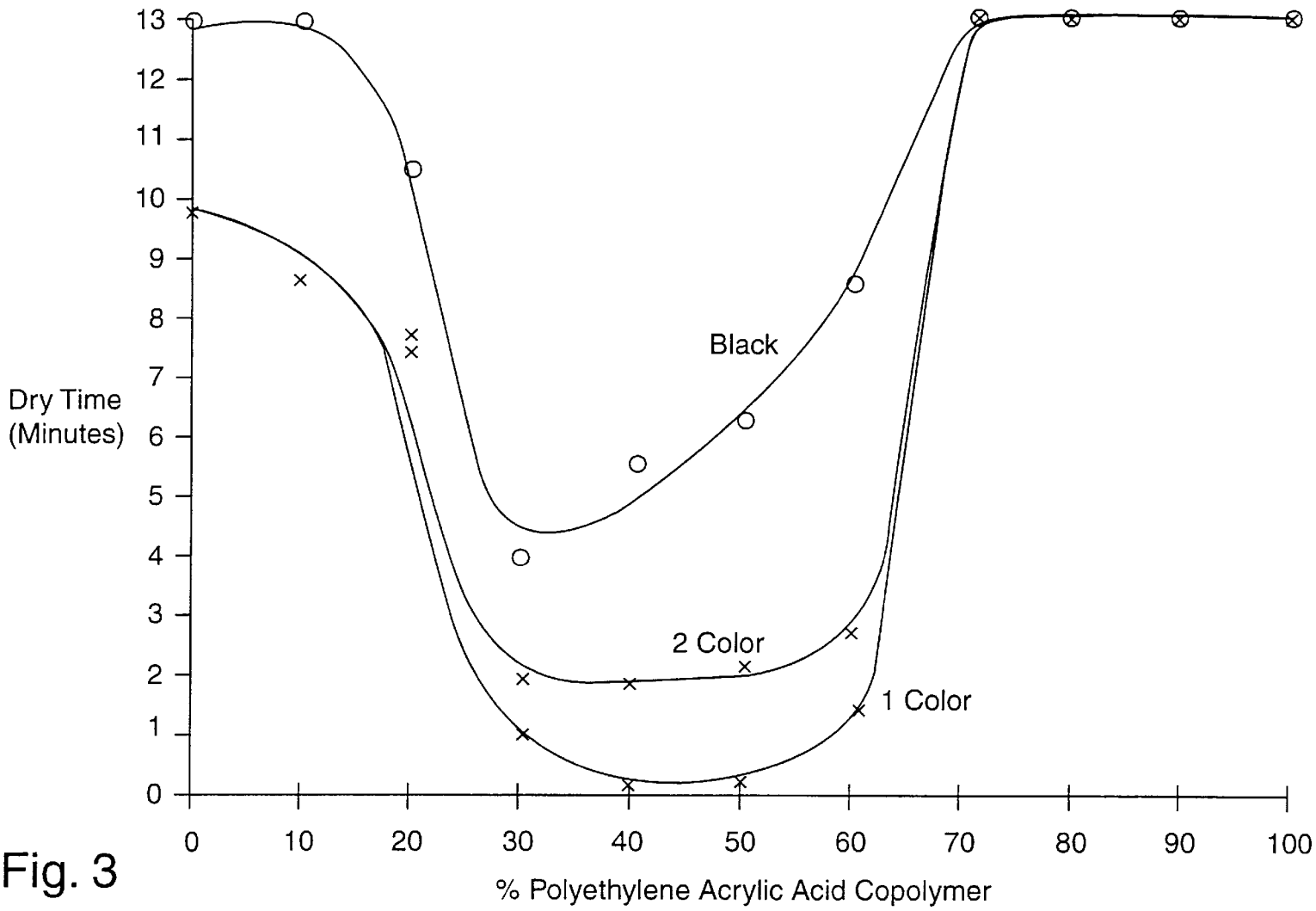
FIG. 3 shows a plot wherein the abscissa shows polyethylene-acrylic acid copolymer percentage of the polymer blend in a single thick ink-receptive layer, plotted against drytimes of ink-receptive sheet of the invention in minutes.

In FIG. 3, data is plotted for a series of coatings made at a high wet coating thickness, approximately twice the coating thickness of the coatings used to generate the coatings used in FIG. 1. Otherwise the method of evaluation and data reduction is similar or identical.

Figure 4:
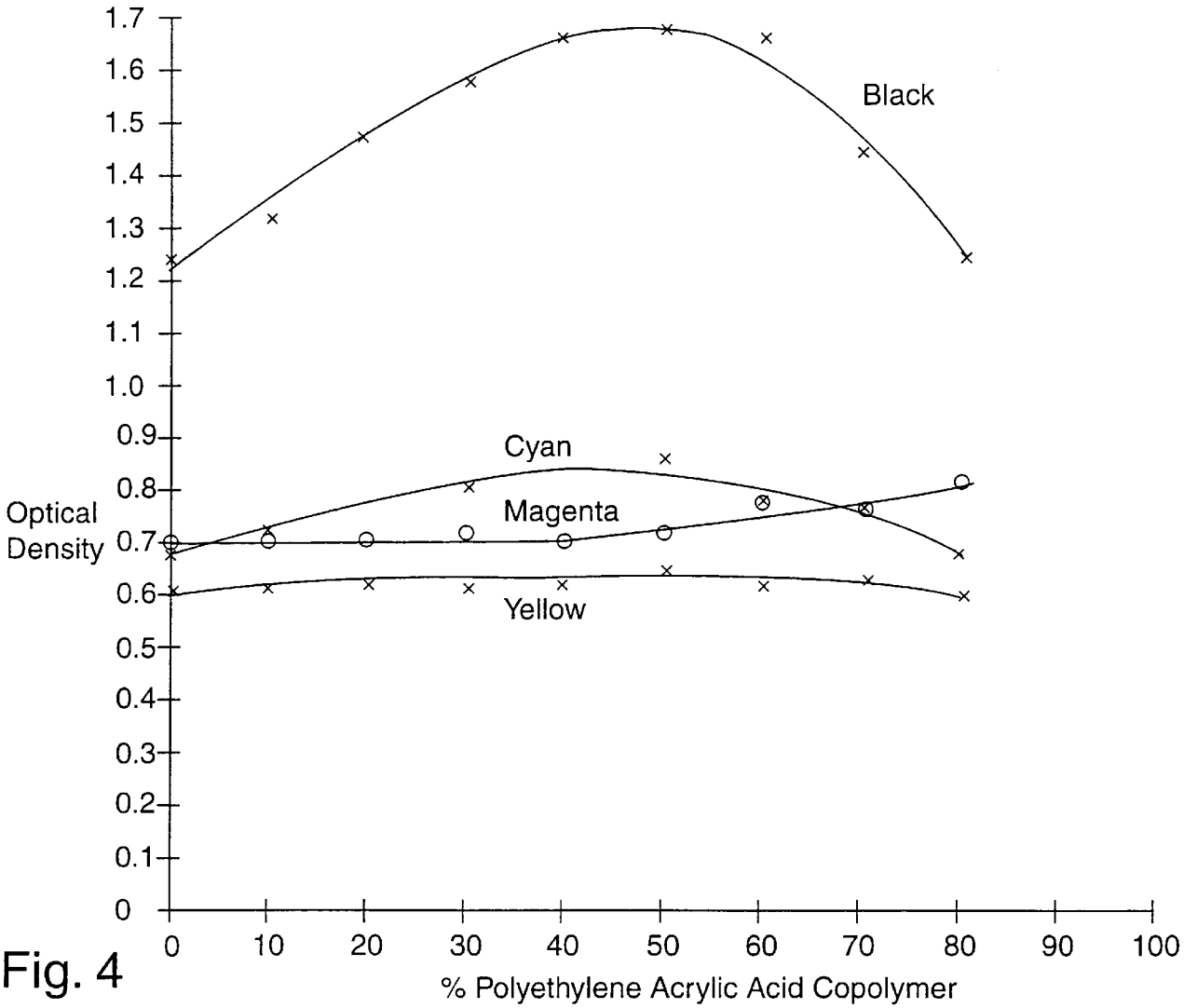
FIG. 4 shows a plot wherein the abscissa shows polyethylene-acrylic acid copolymer percentage of the polymer blend in a single ink-receptive layer, plotted against optical density of imaged sheets of the coatings described in FIG. 3.

FIG. 4, data is plotted for a series of coatings made at a high wet coating thickness, approximately twice the coating thickness of the coatings used to generate the coatings used in FIG. 1. Optical density of selected inks is plotted against the percentage of polyethylene acrylic acid copolymer. It shows that in the chosen optimum region, ink densities are also at their highest values.

Test Methods

Image Density

The transmissive image density is measured using Macbeth TD 903 densitometer with the gold and status A filters.

Dry Time

The environmental conditions for this test are 70° C. and 50% relative humidity (RH). The print pattern consists of solid fill columns of adjacent colors. The columns are ¼" to ½' wide, and 6–9 inches long. After printing the material is placed on a flat surface, then placed in contact with bond paper. A 2 kg rubber roller 2.5" wide is then twice rolled over the paper. The paper is then removed, and the dry time, $D_T$ is calculated by using the following formula:

$$D_T = T_D + (L_T/L_p)T_p$$

where $T_D$ is the length of time between the end of the printing and placing the image in contact with the bond paper. $L_T$ is the length of image transfer to paper; $L_P$ is the length of the printed columns, and $T_P$ is the time of printing.

EXAMPLE 1

This is a series of single layer coatings made by combining various percentages by weight of a polyethylene acrylic acid copolymer and a polyvinyl pyrrolidone polymer. For this example, the former polymer used was Primacor®, available from Dow Chemical Corporation, and the latter polymer used was PVP K-90 from ISP Inc. The Primacor is formulated by dissolution in water to which sufficient ammonia solution has been added to fully react with the acid groups on the polymer. It is believed that a major portion of this added ammonia evaporates when the coatings are dried. The coatings were made, at a wet coating thickness of 100 micrometers, using a flow-bar method, onto 100 micrometer polyethylene terephthalate film ("Scotchpar" film made by Minnesota Mining & Manufacturing Company (3M)) and primed with polyvinylidene chloride. Coatings were evaluated by passing them through a Hewlett Packard Desk Jet® 500C 3-color printer. Dry times were evaluated as outlined in the Test Methods section above. Print densities were measured on a Macbeth TD 903 densitometer. The data on dry times is given in Table 1, and the same data is plotted in FIG. 1, with some smoothing.

TABLE 1

| % by weight Primacor | % by weight PVP | Dry times, minutes: Black (3 inks) | Red/Blue average (2 inks) | Cyan/Magenta average (1 ink) |
|---|---|---|---|---|
| 100 | 0 | 13 | 13 | 13 |
| 90 | 10 | 13 | 13 | 13 |
| 80 | 20 | 13 | 13 | 13 |
| 70 | 30 | 9.76 | 2.75 | 1.0 |
| 60 | 40 | 7 | 2.6 | 0.25 |
| 50 | 50 | 8 | 3.2 | 0.25 |
| 40 | 60 | 10.5 | 3.75 | 2.25 |
| 30 | 70 | 10.75 | 2.75 | 2.0 |
| 20 | 80 | 11.75 | 3.5 | 2.6 |
| 10 | 90 | 12 | 5.75 | 6 |
| 0 | 100 | 13 | 13 | 6.5 |

It may be seen that useful dry times may be achieved when the polyethylene acrylic acid copolymer weight percentage is between 70 and 20.

EXAMPLE 2

A coating solution comprising equal weight percentages of Primacor and PVP K90 was coated onto 100 micrometer polyethylene terephthalate film ("Scotchpar" film manufactured by the 3M Company) at three different wet coating thicknesses. Wet coating thickness in this particular case is proportional to final dry coating weight. The wet coating thicknesses selected were 100 micrometers, 150 micrometers and 200 micrometers. After cutting the dried film into suitably sized sheets, they were imaged in an inkjet printer (an H.P. Deskjet® 500C), and the dry times measured as outlined in the method above. Dry times were measured for black, red, blue, cyan and magenta images, and an overall average calculated. FIG. 2 shows a plot of the average dry times against wet coating thickness.

It was observed that dry time decreases with increased coating thickness, and this may be interpreted as more coating operating to absorb the ink.

EXAMPLE 3

A formulation was made and coated in a similar manner to that outlined in Example 1 except that the composition was 45% by weight of Primacor®, 45% by weight of PVP K-90 and 10% by weight of Pycal® 94. Pycal® 94 is normally regarded as a plasticizer, and is supplied by ICI Americas Inc., Wilmington, Del. It is a polyoxyethylene aryl ether. Table 2 shows the dry times for various ink colors for this material.

TABLE 2

| | Ink color | | | | |
|---|---|---|---|---|---|
| | Red | Magenta | Blue | Cyan | Black |
| Dry time, minutes | 5 | 5 | 6 | 2.75 | 11 |

This data shows that the combination of Primacor and PVP functions with the addition of a plasticizer.

EXAMPLE 4

In Example 1, it was shown that a range of coating compositions yielded acceptable dry times, and in Example 2, that coating thickness was also a determinant of dry times. Accordingly, this example shows the effect on dry times of coating a series of compositions at a higher coating weight. The compositions were the same as used for Example 1, and the wet coating thickness was 200 micrometers. Table 3 gives details of dry times and FIG. 3 shows a plot of the same data. FIG. 4 shows a plot of optical density of images made on these materials of this series when the materials were passed through a Hewlett Packard Deskjet® 500C printer.

TABLE 3

| % by weight Primacor | % by weight PVP | Dry times, minutes Black (3 inks) | Red/Blue average (2 inks) | Cyan/Magenta average (1 ink) |
|---|---|---|---|---|
| 100 | 0 | 13 | 13 | 13 |
| 90 | 10 | 13 | 13 | 13 |
| 80 | 20 | 13 | 13 | 13 |
| 70 | 30 | 13 | 13 | 13 |
| 60 | 40 | 9.0 | 2.7 | 1.4 |
| 50 | 50 | 6.3 | 2.1 | 0.2 |
| 40 | 60 | 5.6 | 1.95 | 0.15 |
| 30 | 70 | 4 | 2 | 1 |
| 20 | 80 | 10.5 | 7.75 | 7.9 |
| 10 | 90 | 13 | 9.1 | 8.75 |
| 0 | 100 | 13 | 10 | 9.25 |

It may be seen that dry times are acceptable for a wide range of Primacor concentrations, and that these concentrations also yield useful optical density values.

EXAMPLE 5

This two layer example was made with a base layer comprising equal weight percentages of Primacor and PVP K-90, coated at a wet thickness of 100 micrometers. This layer was overcoated with an upper layer made as follows:

10 g of a 1.25% aqueous solution of Methocel®K15M was mixed with 10 g of a 1% solution of Methocel® J5MS, 0.8 g of a 28% aqueous solution of PTSA/PEI ratio of 1:1.8, 0.8 g of a 5% aqueous solution of boric acid, 0.2 g of a 30% solution of Ludox® LLS, and 0.5 g of a 10% aqueous solution of LokSiz® 30. The dry times were cyan 0.5 min.; magenta, 0.5 min.; red, 3.5 min.; blue, 3.5 black, 8.0 minutes.

EXAMPLES 6–8

These ink-receptive sheets were 2-layer films. The base layer was made using a formulation consisting of 60% by weight of PVP K-90, 30 percentage parts by weight of Primacor® and 10 percentage parts by weight of Pycal®, and the top layers were as shown in Table 4.

TABLE 4

| | Example number | | |
|---|---|---|---|
| Upper layer composition | 6 | 7 | 8 |
| Methocel K15M | 100 | | |
| Methocel MJ5 | | 100 | |
| PVA (Vinol 540) | | | 52 |
| LokSiz 30 | | | 13 |
| Xanthan gum | | | 35 |

All number are given as percentage parts by weight in the final coating. *Xanthan gum was added with rapid agitation at room temperature, that particular solution being coated out of ethanol. The Methocel upper layers used for examples 6 and 7 were coated from an all-aqueous solution.

These sheets were also tested as above, and the results are shown in Table 5. Example 8 exhibited mud-cracking. Examples 6 and 7 did not exhibit mud cracking. These examples serve to demonstrate that when a two-layer coating system lacking a modified cellulose binder is made, mud-cracking is likely.

TABLE 5

| | Dry Time (min) | | | | |
|---|---|---|---|---|---|
| Ex. | cyan | magenta | red | blue | black |
| 6 | 6 | 3 | 8 | 8 | 12 |
| 7 | 9 | 3.0 | 11 | 6 | 13 |
| 8 | 1.25 | 0.25 | 6.25 | 5.75 | 12 |

EXAMPLES 9a AND 9b

This example shows the use of hydroxypropyl methyl cellulose as a binder in combination with a polyethylene acrylic acid co-polymer. The hydroxypropyl methyl cellulose functions as the hydrophilic component. It is normal to use the polyethylene acrylic acid copolymer prepared as an aqueous dispersion in the presence of ammonia, ammonia derivatives or alkali metal hydroxides. Details of this preparative method may be found in The Dow Chemical Company publication number 305-1256-1284R, (February 1987).

A formulation was made up by mixing 10 parts by weight of a 30% solution of Primacor in water and 10 parts by weight of a 7.9% solution of Methocel K-35 in water. This formulation was then knife-coated onto 100 micrometer polyester film base at two wet coating thicknesses, 150 micrometers and 75 micrometers, (coatings 9a and 9b). The coatings were oven dried for 2 and 1 minute respectively. After drying the coatings were trimmed to 28 cm×21.6 cm sheets and imaged to a color block pattern in a Hewlett Packard DeskJet® 660C printer. The images were air dried overnight before evaluation, but were non touch-sensitive only a few minutes after imaging.

TABLE 6

Characteristics of ink jet coatings 9a and 9b

| Characteristic Example | Optical Transmission Density | | | | |
|---|---|---|---|---|---|
| | Black (to white light) | Cyan (to red light | Magenta (to green light) | Yellow (to blue light) | Haze % |
| 9a | 1.07 | 0.90 | 2.36 | 1.39 | 3.1 |
| 9b | 1.32 | 0.42 | 1.19 | 0.58 | 1.7 |

These values were taken with a Macbeth TD903 Transmission Densitometer, and a BYK Gardner XL-211 Hazegard System.

EXAMPLE 10

This example describes a formulation similar to that of Example 9 except that the ratio of the polyethylene acrylic acid copolymer to hydroxypropyl methyl cellulose has been changed. A coating was also made on an opaque substrate and used to generate reflection images and photographic-like prints.

5 parts by weight of a 30% aqueous solution of Primacor® was mixed with 10 parts by weight of a 7.9% aqueous solution of Methocel® K-35. Coating 10a was made by knife-coating onto 100 micrometer polyester film base at a wet coating thickness of 75 micrometers. The coating was oven dried for 1 minute at 121° C. Coating 10b was made by knife coating onto an opaque polyester film at a wet coating thickness of 75 micrometers. The coating was oven dried at 121° C. for 1 minute. Both coatings were imaged on a Hewlett Packard DeskJet® 660C printer to a color bar pattern, air dried for 12 hours and measured with a Macbeth TD903 densitometer (transmission densities), or a Macbeth TR924 densitometer (reflection densities).

TABLE 7

Characteristics of ink jet coatings 10a

| Characteristic Example | Optical Transmission Density | | | | |
|---|---|---|---|---|---|
| | Black (to white light) | Cyan (to red light | Magenta (to green light) | Yellow (to blue light) | Haze % |
| 10a | 1.87 | 0.42 | 1.05 | 0.51 | 14.2 |
| 10b | 1.54 | 0.56 | 1.53 | 0.78 | |
| Bond Paper control | 1.22 | 0.66 | 0.93 | 1.78 | |

A photographic-style image was also printed onto a sample of coating 10b, and gave good image reproduction. In areas where the coating was absent, the ink formed discrete droplets on the surface of the base, and 12 hours later was still extremely sensitive to touch. In the areas that were coated, the image was damaged only by relatively rough treatment.

EXAMPLE 11

This example demonstrates the use of a partially hydrolyzed polyvinyl acetate/alcohol in combination with a polyethylene acrylic acid copolymer.

To 5 parts by weight of a 30% by weight dispersion of Primacor® in water was added 10 parts by weight of a 16% by weight solution of Ghosel® KP-06, which is a 75% hydrolyzed polyvinyl acetate/polyvinyl alcohol material. The mixture was well shaken and bubbles allowed to rise to the surface and collapse. The formulation was knife coated on 100 micrometer opaque, polyester substrate as a wet coating thickness of 100 micrometers. This coating was oven dried at 121° C. for 1½ minutes, and cut to 21.6 cm×28 cm sheets. This coating was labeled 11a. A second coating identical to the first was then made on 100 micrometer clear polyester film base. This coating was labeled 11b.

11a was a smooth, glossy coating with no obvious voids or non-wetting area. 11b was a clear, uncolored coating, of similar quality to 11a. Both coatings were evaluated in a Hewlett Packard DeskJet® 660C ink jet printer. 11a was imaged with a color bar pattern at the "Glossy paper" setting, while 11b was imaged with a stored photographic style image at the "transparency" setting. Both materials were dry to the touch after sitting 10 minutes in normal room conditions.

11a gave reflection densities, measured with a Macbeth TR924 reflection densitometer, of black, 2.70, cyan 1.63, magenta 3.16 and yellow 2.30.

11b showed low haze, and good image quality. It was compared with 3M ink jet film CG 3460 and gave similar results when compared side-by-side on an overhead projector.

What is claimed is:

1. An ink-receptive sheet comprising a substrate and an ink-receptive coating, said coating comprising a blend of polymers, said blend comprising from about 35% to about 85% by weight of a hydrophilic liquid absorbent polymer and from about 15% to about 65% by weight of a polyethylene-acrylic acid copolymer.

2. An ink-receptive sheet according to claim 1 wherein said polyethylene-acrylic acid copolymer comprises at least about 10% by weight acrylic acid.

3. An ink-receptive sheet according to claim 2 wherein said polyethylene-acrylic acid copolymer comprises at least about 20% by weight acrylic acid.

4. An ink-receptive sheet according to claim 1 wherein said coating has a thickness of from about 10 $\mu$m to about 40 $\mu$m.

5. An ink-receptive sheet according to claim 1 wherein said blend comprises from about 20% to about 35% by weight of said polyethylene-acrylic acid copolymer.

6. An ink-receptive sheet according to claim 1 wherein said coating further comprises a polymeric mordant.

7. An ink-receptive sheet according to claim 1 wherein said substrate is transparent.

8. An ink-receptive sheet according to claim 7 wherein said substrate is selected from the group consisting of cellulose triacetate, cellulose diacetate, poly(ethylene naphthalate), polyesters, and polystyrene films.

9. An ink-receptive sheet according to claim 8 wherein said polyester is poly(ethylene terephthalate).

10. An ink-receptive sheet comprising a coating system comprising at least two layers, a liquid absorbent base layer having a thickness of from about 10 $\mu$m to about 40 $\mu$m, and a thinner ink-transmissive upper layer having a thickness of from about 0.5 $\mu$m to about 10 $\mu$m, wherein said base layer comprises a blend of polymers, said blend comprising from about 35% to about 85% by weight of a hydrophilic liquid absorbent polymer and from about 15% to about 65% by weight of a polyethylene-acrylic acid copolymer.

11. An ink-receptive sheet according to claim 10 wherein said polyethylene-acrylic acid copolymer comprises at least about 10% by weight acrylic acid.

12. An ink-receptive sheet according to claim 6 wherein said blend of polymers in said base layer comprises from about 20% to about 45% of said polyethylene-acrylic acid copolymer.

13. An ink-receptive sheet according to claim 10 wherein said base layer of said coating system comprises a hydrophilic liquid absorbent polymer selected from the group consisting of polyacrylamides, polyvinylpyrrolidone, copolymers formed from N-vinyl pyrrolidone and vinyl acetate, copolymers formed from N-vinyl pyrrolidone and dimethaminoethylmethacrylate, copolymers formed from N-vinyl pyrrolidone and acrylic acid, copolymers formed from N-vinyl pyrrolidone and monoethanolaminehydroxyethylmethacrylate/acrylic acid; polyvinyl alcohol, and copolymers of polyvinyl alcohol with vinyl acetate.

14. An ink-receptive sheet comprising a two-layer coating system according to claim 13, wherein said liquid absorbent base layer comprises a blend of said polyethylene-acrylic acid copolymer and polyvinylpyrrolidone.

15. An ink-receptive sheet comprising a two layer coating system according to claim 10 wherein said ink-transmissive upper layer comprises a cellulose selected from the group consisting of methylcellulose, hydroxypropylmethylcellulose, and blends thereof, said cellulose having a viscosity of more than 2,000 centipoise as a 20% aqueous solution.

16. An ink-receptive coating system comprising a two-layer coating system according to claim 10 wherein said upper layer comprises a) a binder selected from the group consisting of methylcellulose, hydroxypropylmethylcellulose, and blends thereof having viscosities of more than 2,000 centipoise as a 20% aqueous solution, and b) an organic acid salt selected from the group consisting of salts of polyethyleneimine and salts of substituted polyethyleneimine.

17. An ink-receptive sheet according to claim 10 wherein said ink-transmissive upper layer of said two-layer coating system comprises a mordant therein.

18. An ink-receptive sheet according to claim 10 wherein said ink-transmissive upper layer comprises an additive to prevent mud-cracking, said additive being selected from the group consisting of water soluble starches, inorganic sols, and water dispersible clays.

* * * * *